United States Patent [19]

Davis et al.

[11] Patent Number: 4,866,483

[45] Date of Patent: Sep. 12, 1989

[54] CLEANING STATION FOR USE IN AN ELECTROPHOTOGRAPHIC PRINT ENGINE

[75] Inventors: David R. Davis, Buford; Danny L. Slayton, Lilburn, both of Ga.

[73] Assignee: Colorocs Corporation, Norcross, Ga.

[21] Appl. No.: 194,812

[22] Filed: May 17, 1988

[51] Int. Cl.[4] ..... G03G 21/00

[52] U.S. Cl. ..... 355/299; 355/212; 355/200

[58] Field of Search ..... 355/3 DR, 3 BE, 15; 118/652

[56] References Cited

U.S. PATENT DOCUMENTS

| | | | |
|---|---|---|---|
| 3,552,850 | 1/1971 | Royka et al. | 355/15 |
| 4,538,896 | 9/1985 | Tajima et al. | 355/3 DR X |
| 4,652,115 | 3/1987 | Palm et al. | 355/14 TR |
| 4,788,572 | 11/1988 | Slayton et al. | 355/3 BE X |

FOREIGN PATENT DOCUMENTS

| | | | |
|---|---|---|---|
| 0173870 | 10/1982 | Japan | 355/15 |
| 0105670 | 6/1984 | Japan | 355/15 |

*Primary Examiner*—R. L. Moses
*Assistant Examiner*—Robert Beatty
*Attorney, Agent, or Firm*—Jones, Askew & Lunsford

[57] ABSTRACT

Improved cleaning stations for use in electrophotographic print engines having cleaning elements which are simple to inspect, remove, clean, and replace. The photoreceptor belt cleaning station is positioned in one frame of the print engine and the photoreceptor medium is positioned in the other frame of the print engine so that the cleaning station is directly accessible when the print engine is open. Also, when the print engine is closed, the photoreceptor medium contacts the cleaning elements at a substantially perpendicular angle resulting in minimum stress to both the photoreceptor medium and the cleaning elements.

6 Claims, 3 Drawing Sheets

CLEANING STATION FOR USE IN AN ELECTROPHOTOGRAPHIC PRINT ENGINE

TECHNICAL FIELD

The present invention relates to cleaning stations for use in electrophotographic print engines, and more particularly relates to an improved cleaning station having cleaning blades which are easily removed, cleaned, and replaced.

BACKGROUND OF THE INVENTION

Electrophotography refers to producing photographic images by electrical means, and xerography is a form of electrophotography for copying documents and other graphic matter. Xerographic copiers are extensively used in a variety of environments, such as offices, libraries, and educational institutions.

The basic elements of a xerographic copier are well known to those skilled in the art. A light source forms an electrostatic latent image of an original document on a photosensitive medium. The photosensitive medium, as it moves within the copier, travels adjacent a source of tiny plastic particles called toner. The electrostatic force of the latent image on the photosensitive medium attracts the toner, thereby providing a developed image of toner particles on the surface of the photosensitive medium. The toner image is transferred through electrostatic charges to an image receptor, which is normally a sheet of paper or plastic. The image receptor then passes through a heating device which melts the toner particles, thereby fixing or fusing the image of the original onto the image receptor.

After the toner image is transferred to the image receptor, some toner particles remain clinging to the surface of the photosensitive medium. Furthermore, toner is a fine powder and some toner particles become airborne within the xerographic copier and cling to the surface of the photosensitive medium as the copier operates. A cleaning station, set up adjacent to the photosensitive medium, removes the clinging toner before the next image is formed. Otherwise, the clinging toner would contaminate subsequent images formed on the photosensitive medium.

As is well known in the prior art, the cleaning station gradually becomes filled with toner and that toner must be removed. In order to remove the toner from a cleaning station, the cleaning station must be removed from the xerographic copier. In conventional xerographic copiers, access to the cleaning station is difficult. As a result, it is difficult to remove the cleaning station without spilling toner into the copier as the cleaning station is removed. The toner tends to become airborne when spilled, and this airborne toner settles throughout the copier, contaminating images formed on the photosensitive medium and causing abrasive damage to various moving parts.

As is also well known in the prior art, the cleaning element of the cleaning station gradually degrades and must be replaced. In conventional xerographic copiers, the cleaning station must be removed to replace the cleaning element. Therefore, the same problems discussed above are encountered when replacing the cleaning element.

More recently, laser printers have become popular office machines. As is known to those skilled in the art, laser printers are usually constructed with print engines which are similar to those used in xerographic copiers.

A raster-scanned laser beam creates the latent image directly on the photosensitive medium in a laser printer. After the image is created on the photosensitive medium, the printing process is similar to that in a xerographic copier.

Therefore, there is a need in electrophotographic print engines or laser print engines for a cleaning station which is simpler to clean, remove, and replace without damaging other internal parts.

SUMMARY OF THE INVENTION

The present invention solves the above problems in the prior art in several significant aspects. Generally, the present invention includes an electrophotgraphic print engine comprising a first frame and a second frame connected to one another so that the print engine can be opened and closed. A photoreceptor medium housed in one of the first and second frames transfers toner and a cleaning element housed in the other frame cleans toner from the photoreceptor medium. The cleaning element is positioned next to the photoreceptor medium when the print engine is closed.

The novel construction of the present invention facilitates the removal of toner from the cleaning element and replacement of the cleaning element by allowing easy access to the interior of the electrophotographic print engine. To gain access to the cleaning element, the operator simply separates the first frame from the second frame. Because the photoreceptor medium is housed in one frame while the cleaning element is housed in the other frame, the photoreceptor medium separates from the cleaning element as the first and second frames are separated. Thus, the cleaning element is exposed and may be directly inspected, removed from the print engine, and then replaced. The ease of this operation allows sure handling of the cleaning element when removed from the print engine, thereby preventing the spillage of toner into the print engine. In addition, because the cleaning element is directly exposed, the toner removed by the cleaning element can be vacuumed with a conventional vacuum cleaner without removing the cleaning element from the print engine.

Stated somewhat more specifically, the first frame and second frame of the present invention are connected at one end by a hinge so the print engine may be opened by lifting one end of the first frame from the second frame and closed by pushing the same end of the first frame back down to the second frame. Also, the cleaning element is positioned in the print engine so that the cleaning blade initially contacts the flat outer surface of the photoreceptor medium at an angle substantially perpendicular to the outer surface when the print engine closes. This feature of the present invention reduces the wear on the photoreceptor medium caused by the cleaning blade striking the photoreceptor medium when the print engine closes. Because the cleaning blade strikes the flat surface of the photoreceptor medium at an angle substantially perpendicular to the photoreceptor medium, the resultant force of the contact is substantially perpendicular to the photoreceptor medium. Therefore, there is little or no side load on the cleaning blade at the point of initial contact, so the cleaning blade does not buckle under the photoreceptor medium nor does the cleaning blade stretch the flat surface of the photoreceptor medium.

Therefore, an object of the present invention is to provide an improved electrophotographic print engine.

Another object of the present invention is to provide an electrophotographic print engine wherein the cleaning elements are easily accessible for cleaning and replacement thereof.

Another object of the present invention is to provide an electrophotographic print engine wherein the damage to photoreceptor mediums caused by cleaning elements is reduced.

A further object of the present invention is to provide an electrophotographic print engine wherein used toner can be removed from cleaning elements and cleaning elements can be replaced with a minimum of toner dispersion.

Other objects, features, and advantages will become apparent from reading the following specification in conjunction with the accompanying drawings.

DETAILED DESCRIPTION OF THE PREFERRED EMBODIMENT

Figure 1:
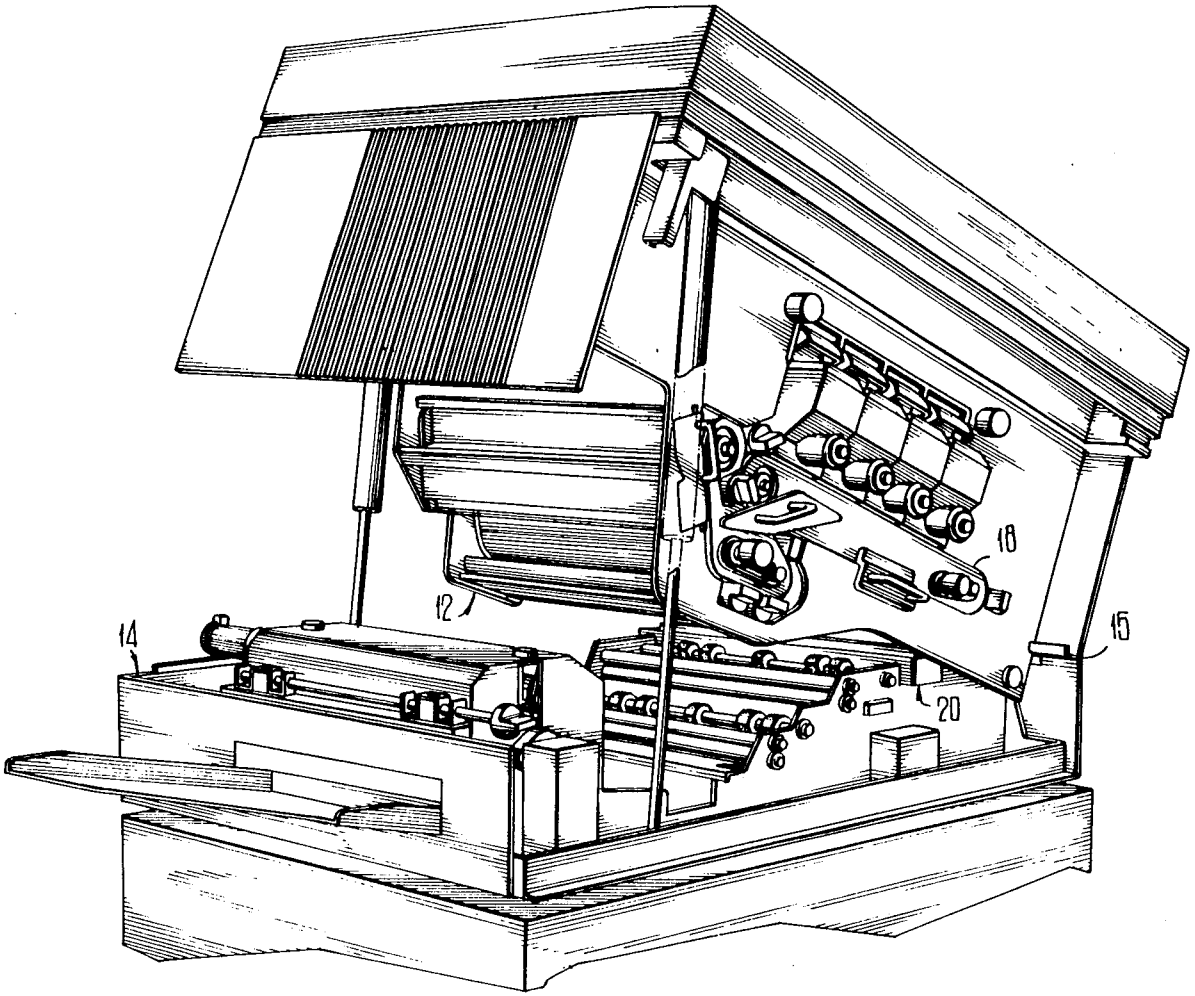
FIG. 1 is a perspective view of an open print engine, according to the preferred embodiment of the present invention.

As shown generally in FIG. 1, the improved electrophotographic print engine 10 comprises an upper frame 12 and a lower frame 14 connected by a hinge 15 whereby the upper frame and lower frame can rotate relative to one another. This gives the print engine 10 a clam-shell like appearance and operation. The print engine 10 can be opened by applying an upward force to the end of the upper frame 12 opposite the hinge 15, thereby causing the upper frame to rotate about the hinge and lift from the lower frame 14. The print engine 10 can then be closed by applying a downward force to the end of the upper frame 12 opposite the hinge 15. The print engine 10 also includes a photoreceptor belt 18 which is positioned in the upper frame 12, so that the photoreceptor belt is exposed when the print engine is open. In addition, a photoreceptor belt cleaning station 20 is positioned in the lower frame 14 so that the cleaning blade station is exposed when the print engine 10 is open and is contacting the photoreceptor belt 18 when the print engine is closed.

Figures 2, 6:
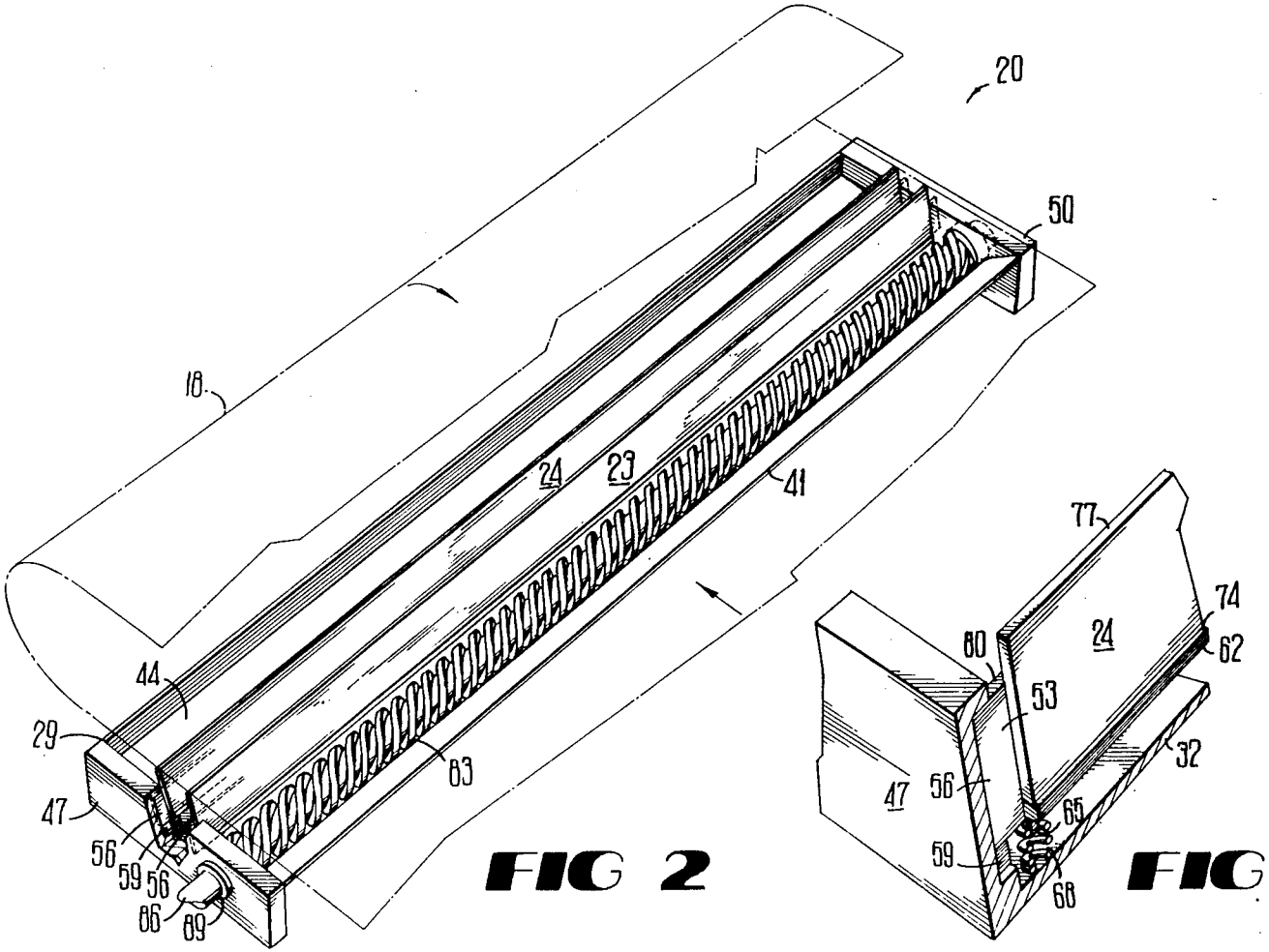
FIG. 2 is a perspective view of a cleaning blade station, according to the preferred embodiment of the present invention. A fragmentary perspective view of a photoreceptor belt is shown in phantom.
FIG. 6 is a sectional fragmentary perspective view of a cleaning blade station according to a preferred embodiment of the present invention enlarged to illustrate detail at one end of the cleaning blade and cleaning blade guide.
Figure 3:
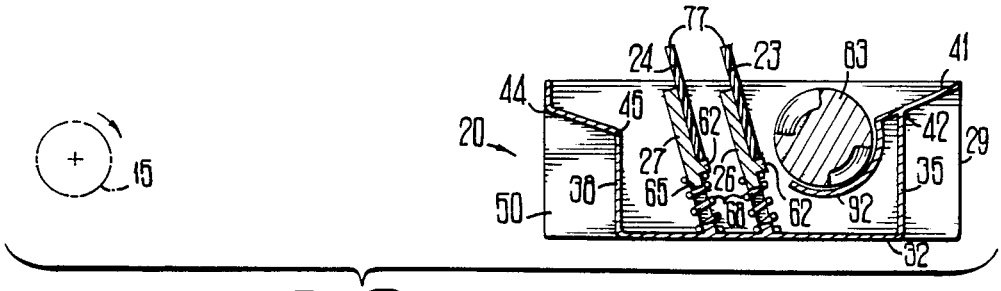
FIG. 3 is a sectional side elevation view of the preferred embodiment of the cleaning blade station of the present invention illustrating the position of the cleaning blades and photoreceptor belt, a fragment of which is shown in phantom, when the print engine is open.

Turning to FIGS. 2 and 3, the photoreceptor belt cleaning station 20 is shown generally comprising two cleaning blades 23 and 24 mounted on separate cleaning blade holders 26 and 27 contained in a cleaning blade housing 29. The cleaning blade housing 29 includes a rectangular flat bottom plate 32 (see FIG. 3) and two rectangular vertical plates 35 and 38 which extend upward from the opposite longitudinal edges of the flat bottom plates. A sloped edge 41 extends outwardly from the top longitudinal edge 42 of vertical plate 35. Another sloped edge 44 extends outwardly from the top longitudinal edge 45 of vertical plate 38. End plates 47 and 50 attached to the opposite ends of bottom plate 32 and the vertical plates 35 and 38 give the cleaning blade housing 29 a trough-like appearance.

The cleaning blade holders 26 and 27 each comprise a narrow rectangular member 53 which extends from end plate 47 to end plate 50. Each end 56 of the member 53 for each cleaning blade holder 26 and 27 fits intgrally within the rectangular cleaning blade guide channels 59 located in the end plates 47 (see FIG. 6) and 50. A narrow longitudinal rib 62 protrudes from one face of and runs the length of each cleaning blade holder 26 and 27, near the lower edge of each blade holder. Pegs 65 extend below the lower edge of each cleaning blade holder 26 and 27 at opposite ends of the cleaning blade holders. Each peg 65 fits into a corresponding spring 68 which rests on the bottom plate 32 of the cleaning blade housing. The springs 68 provide a positive force resiliently urging the cleaning blade holders 26 and 27 in the direction of the photoreceptor belt 18.

The cleaning blades 23 and 24 each comprise a flat and narrow rectangular strip of flexible material which extends along the length of the cleaning blade holders 26 and 27. The lower edge 74 of each cleaning blade 23 and 24 rests on top of the narrow rib 62 protruding from each corresponding cleaning blade holder 26 and 27, and the flat surface of each cleaning blade rests against the flat surface of the cleaning blade holder. The cleaning blades 23 and 24 are preferably secured to the cleaning blade holders 26 and 27 with an adhesive. The top edge 77 of each cleaning blade 23 and 24 extends above and beyond the top edge 80 of the respective cleaning blade holders 26 and 27 towards the photoreceptor belt 18 as shown in FIGS. 3 and 5.

The photoreceptor belt cleaning station 20 also includes an auger 83 which extends from end plate 47 to end plate 50 parallel and proximate to the cleaning blades 23 and 24. Rounded ends 86 extend from each end of the auger 83 and fit into holes 89 in the end plates 47 and 50. One auger end 86 engages a drive mechanism (not shown) which rotates the auger. A rounded auger dish 92 extends inwardly from the top edge 42 of the vertical plate 35 at one side of the cleaning blade housing 29. The inner surface of the auger dish 92 closely conforms to the surface of the auger 83 and extends below the auger (see FIGS. 3 and 5).

The cleaning blade housing 29 and the cleaning blade holders 26 and 27 preferably comprise a light metal, such as aluminum, or a plastic. Also, the cleaning blades 23 and 24 preferably comprise a flexible elastomeric material such as rubber.

Figure 5:
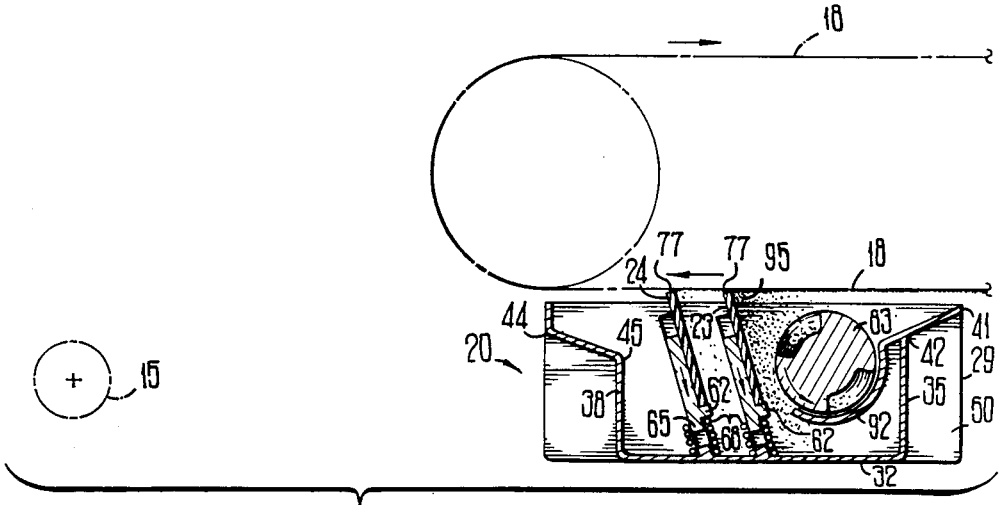
FIG. 5 is a sectional side elevation view of the preferred embodiment of the cleaning blade station of the present invention when the print engine is operating. A fragmentary elevation view of the photoreceptor belt is shown in phantom.

When the print engine 10 is in operation, as shown in FIG. 5, the print engine is closed and therefore, the upper edges 77 of the cleaning blades 23 and 24 are in contact with the outer surface of the photoreceptor belt 18. As the print engine operates, the photoreceptor belt 18 travels in a clockwise direction, as seen in FIG. 5, and slides across the upper edge 77 of each of the cleaning blades 23 and 24. As a result, the residual toner 95 on the outer surface of the photoreceptor belt 18 is removed by the cleaning blades 23 and 24.

The majority of toner 95 removed from the photoreceptor belt 18 by the first cleaning blade 23 falls onto the auger 83 and into the rounded auger dish 92. As the auger 83 rotates, it carries the used toner 95 to an opening (not shown) in the rounded auger dish 92 where the used toner 95 falls into a receptable (not shown). The auger 83 thus removes most of the used toner 95 from the cleaning blade station 20; nevertheless, some toner 95 removed by the first cleaning blade 23 and all of the toner removed by the second cleaning blade 24 collects on the bottom plate 32 of the cleaning blade station.

Returning to FIG. 1, a particular advantage of the print engine 10 can be seen in that the photoreceptor belt cleaning station 20 is exposed and easily accessible when the print engine is open (see also FIG. 3). When the upper frame 12 is lifted from the lower frame 14, the photoreceptor belt is lifted as well while the photoreceptor belt cleaning station 20 remains in the lower frame. The cleaning blades 23 and 24 thus are directly exposed for inspection, removal, and/or replacement without removing the entire cleaning blade station 20 from the print engine 10. In addition, the used toner 95 caught in the cleaning blade housing 29 can be vacuumed without removing the cleaning blade station 20.

Figure 4:
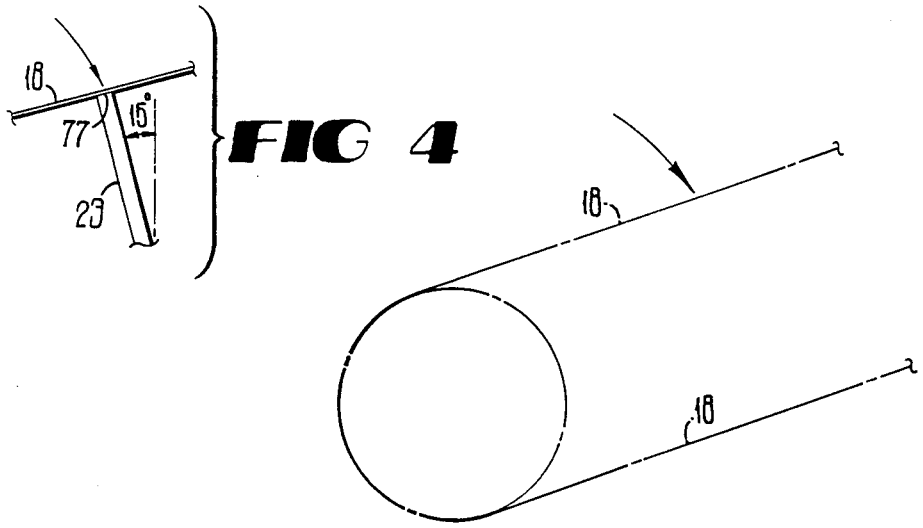
FIG. 4 is a fragmentary side elevation view of a cleaning blade initially contacting the photoreceptor belt as the print engine closes, according to the preferred embodiment of the present invention.

Turning to FIG. 4, another particular advantage of the print engine 10 can be seen. The cleaning blades 23 and 24, the cleaning blade holders 26 and 27, and the cleaning blade guides 59, are set an angle from the vertical; this angle is 15° in the preferred embodiment, although the exit angle is not critical. The upper frame 12 is positioned relative to lower frame 14 so that when the upper frame 12 of the print engine 10 is moved down toward the lower frame 14, the photoreceptor belt 18 initially contacts the upper edges 77 of the cleaning blades 23 and 24 at a substantially perpendicular angle (see FIG. 4). As a result, at the point of initial contact, the angle of force from the contact is parallel to the height of the cleaning blades 23 and 24 and the cleaning blade guides 59. Thereafter, as the upper frame 12 is further lowered and secured to the lower frame 14, the cleaning blades 23 and 24 retract (see figure 5), sliding down the cleaning blade guides 59 against the force of the springs 68 with a minimal side load exerted on the cleaning blades 23 and 24 and a minimal component of force in the direction parallel to the surface of the photoreceptor belt 18. As a result, the cleaning blades 23 and 24 are less likely to bind under the photoreceptor belt 18 and detach from the cleaning blade holders and are less likely to stretch and damage the surface of the photoreceptor belt.

It should be understood that the foregoing relates only to a preferred embodiment of the present invention, and that numerous changes and modifications therein may be made without departing from the spirit and scope of the invention as defined by the following claims.

We claim:

1. An electrophotographic print engine comprising:
a first frame;
a second frame operatively associated with the first frame;
means for selectively displacing said first frame from said second frame to open the electrophotographic print engine, and alternatively for securing said first frame to said second frame to close said electrophotographic print engine;
a photoreceptor medium housed in one of said first or second frames and having an outer surface for transferring toner; and
means housed in one of said frames for cleaning the toner from said photoreceptor medium housed in the other frame and mounted so as to initially contact said outer surface of said photoreceptor medium at an angle substantially perpendicular to the outer surface as the electrophotographic print engine is being closed, preventing contact at an acute angle to the outer surface and thereby reducing wear on the cleaning means and the photoreceptor medium, and to subsequently retract responsive to the contact of said photoreceptor medium during closing of the electrophotographic print engine, while remaining in contact with said outer surface, to a position at which said cleaning means contacts said outer surface at an acute angle.

2. An electrophotographic print engine as in claim 1, wherein the frame housing the cleaning means is positioned below the frame housing the photoreceptor medium.

3. An electrophotographic print engine comprising:
a first frame;
a second frame operatively associated with the first frame;
a hinge operatively interconnecting the first frame and the second frame for relative rotation about said hinge so the first frame can selectively be displaced from the second frame to open the electrophotographic print engine, and alternatively, the first frame can be secured to the second frame to close the electrophotographic print engine;
a photoreceptor medium housed in one of the frames and having an outer surface for transferring toner;
a cleaning blade housed in the other frame for cleaning the toner from said photoreceptor medium and positioned to initially contact the outer surface of the photoreceptor medium at an angle substantially perpendicular to the outer surface as the electrophotographic print engine is being closed, preventing initial contact at an acute to the outer surface and thereby reducing the wear on the cleaning blade and the photoreceptor medium;
urging means for urging the cleaning blade against the outer surface; and
means in the other frame for guiding the cleaning blade so that the cleaning blade retracts against the urging means, responsive to the contact of the outer surface during closing of the electrophotographic print engine, to a position at which the cleaning blade contacts the outer surface at an acute angle.

4. An electrophotographic print engine as in claim 3, wherein the frame housing the cleaning blade is positioned below the framing housing the photoreceptor medium.

5. An electrophotographic print engine, comprising:
a first frame;
a second frame operatively associated with the first frame;
means for selectively displacing the first frame from the second frame to open the electrophotographic print engine, and alternatively for securing the first frame to the second frame to close the electrophotographic print engine;

a photoreceptor medium housed in one of the first or second frames and having an outer surface for transferring toner;

means housed in one of said frames for cleaning toner from the photoreceptor medium housed in the other frame and positioned to initially contact the outer surface of the photoreceptor medium at an angle substantially perpendicular to the outer surface as the electrophotographic print engine is being closed, preventing initial contact at an acute angle to the outer surface and thereby reducing the wear on the cleaning blade and the photoreceptor medium;

urging means for urging the cleaning means against the outer surface; and means in the frame housing the cleaning means for guiding the cleaning means so that the cleaning means retracts against the urging means, responsive to the contact of the outer surface during closing of the electrophotographic print engine, to a position at which the cleaning means contacts the outer surface at an acute angle.

6. An electrophotographic print engine as in claim 5, wherein the frame housing the cleaning means is positioned below the frame housing the photoreceptor medium.

* * * * *